US010883767B2

(12) United States Patent
Lee et al.

(10) Patent No.: US 10,883,767 B2
(45) Date of Patent: Jan. 5, 2021

(54) MULTI-FLUID HEAT EXCHANGER

(71) Applicant: NATIONAL UNIVERSITY OF SINGAPORE, Singapore (SG)

(72) Inventors: Poh Seng Lee, Singapore (SG); Chuan Sun, Singapore (SG)

(73) Assignee: NATIONAL UNIVERSITY OF SINGAPORE, Singapore (SG)

( * ) Notice: Subject to any disclaimer, the term of this patent is extended or adjusted under 35 U.S.C. 154(b) by 85 days.

(21) Appl. No.: 16/310,729

(22) PCT Filed: Jul. 5, 2017

(86) PCT No.: PCT/SG2017/050341

§ 371 (c)(1),
(2) Date: Dec. 17, 2018

(87) PCT Pub. No.: WO2018/013054

PCT Pub. Date: Jan. 18, 2018

(65) Prior Publication Data

US 2019/0331427 A1 Oct. 31, 2019

(30) Foreign Application Priority Data

Jul. 11, 2016 (SG) ..... 10201605658V

(51) Int. Cl.
*F25D 9/00* (2006.01)
*F28D 9/00* (2006.01)

(52) U.S. Cl.
CPC ..... *F28D 9/0093* (2013.01); *F28D 9/005* (2013.01)

(58) Field of Classification Search
CPC ..... F28D 9/0093; F28D 9/005; F28D 9/00; F28D 1/0325; F28D 1/0461
See application file for complete search history.

(56) References Cited

U.S. PATENT DOCUMENTS 5,755,280 A 5/1998 Da Costa et al.
6,089,313 A 7/2000 Levy et al.
(Continued)

FOREIGN PATENT DOCUMENTS

CN 102639953 A 8/2012
DE 202008017767 U1 6/2010
(Continued)

OTHER PUBLICATIONS

Zhang, Hainan, et al., "Numerical investigation on fin-tube three-fluid heat exchanger for hybrid source HVAC&R systems", Applied Thermal Engineering 95 (2016), pp. 157-164.
(Continued)

*Primary Examiner* — Elizabeth J Martin
(74) *Attorney, Agent, or Firm* — Innovation Capital Law Group, LLP; Vic Lin

(57) ABSTRACT

A multi-fluid heat exchanger (100) includes a primary section (102) and a secondary section (104) arranged contiguous with the primary section (102). The multi-fluid heat exchanger (100) further includes a first heat transfer channel (106) arranged to carry a first fluid (118) and the first heat transfer channel (106) extends between the primary section (102) and the secondary section (104) and carries the first fluid (118) between the sections (102,104). The multi-fluid heat exchanger (100) also includes a second heat transfer channel (108) disposed only at the primary section (102) and arranged to carry a second fluid (114) for heat exchange between the first and second fluids (112,114) at the primary section (102) and a third heat transfer channel (110) disposed only at the secondary section (104) and arranged to carry a third fluid (116) for heat exchange between the first and third fluids (112,116) at the secondary section (104).

13 Claims, 6 Drawing Sheets

(56) References Cited

U.S. PATENT DOCUMENTS

| | | | | |
|---|---|---|---|---|
| 2002/0178746 | A1 | 12/2002 | Gupte | |
| 2004/0159424 | A1 | 8/2004 | Reinke et al. | |
| 2005/0236145 | A1 | 10/2005 | Arai et al. | |
| 2007/0267000 | A1 | 11/2007 | Raduenz et al. | |
| 2009/0159246 | A1 | 6/2009 | Cornet et al. | |
| 2012/0234523 | A1* | 9/2012 | Jouanny ..... | F28F 9/0246 165/166 |

FOREIGN PATENT DOCUMENTS

| | | | |
|---|---|---|---|
| EP | 1054225 | A1 | 11/2000 |
| JP | 2000337784 | A | 12/2000 |
| JP | 2006010130 | A | 1/2006 |
| WO | 2004017006 | A2 | 2/2004 |
| WO | 2004042312 | A1 | 5/2004 |

OTHER PUBLICATIONS

International Search Report & Written Opinion dated Sep. 11, 2017 from PCT Application No. PCT/SG2017/050341.

* cited by examiner

MULTI-FLUID HEAT EXCHANGER

BACKGROUND AND FIELD

The invention relates to a multi-fluid heat exchanger.

In a typical plate heat exchanger, transfer of heat is only possible between two fluid mediums, which flow in chambers separated by plates. Heat exchangers which transfer heat between three or more fluid mediums have been proposed but such heat exchangers are complex and suffer from inefficient heat transfer and high pressure drops. Such heat exchangers may also be prone to fouling due to restricted flow channels.

It is desirable to provide a multi-fluid heat exchanger which addresses at least one of the drawbacks of the prior art and/or to provide the public with a useful choice.

SUMMARY

In a first aspect, there is provided a multi-fluid heat exchanger comprising a primary section and a secondary section arranged contiguous with the primary section; a first heat transfer channel arranged to carry a first fluid, the first heat transfer channel extending between the primary section and the secondary section and arranged to carry the first fluid between the sections; a second heat transfer channel disposed only at the primary section and arranged to carry a second fluid for heat exchange between the first and second fluids at the primary section; and a third heat transfer channel disposed only at the secondary section and arranged to carry a third fluid for heat exchange between the first and third fluids at the secondary section.

The described embodiments may be able to achieve higher heat transfer efficiency and low pressure drop of the primary and secondary sections and this may also help to improve the thermal and hydraulic performance of the heat exchanger.

Preferably, the first fluid channel may include a plurality of first fluid chambers, at least some of which may be interleaved by respective ones of a plurality of second fluid passages of the second fluid channel. In an embodiment, all of the plurality of first fluid chambers may extend between the primary section and the secondary section. In such an embodiment, the first fluid channel may include a first fluid inlet disposed at the primary section and a first fluid outlet disposed at the secondary section. The third fluid channel may include a third fluid inlet disposed at the secondary section and a third fluid outlet disposed at the secondary section. In a specific example, the secondary section may be arranged downstream of the primary section in relation to a flow path of the first fluid.

In another embodiment, some of the plurality of first fluid chambers may be disposed in the primary section and some of the plurality of first fluid chambers may be disposed in the secondary section. In such an embodiment, the first fluid channel may include a first fluid inlet and outlet disposed at the secondary section. The third fluid channel may include a third fluid inlet and outlet disposed at the secondary section. In a specific example, the primary section may be arranged downstream of the secondary section in relation to a flow path of the first fluid.

There may be an even number of first fluid chambers, but there might be an odd number, depending on application.

Preferably, the second fluid channel may include a second fluid inlet and outlet which may extend an entire length of the primary section.

Advantageously, the primary and secondary sections may be integrally formed as a unitary structure.

It should be appreciated that features relevant to one aspect may also be relevant to the other aspects.

BRIEF DESCRIPTION OF THE DRAWINGS

Exemplary embodiments will now be described with reference to the accompanying drawings, in which.

DETAILED DESCRIPTION OF PREFERRED EMBODIMENTS

Figure 1:
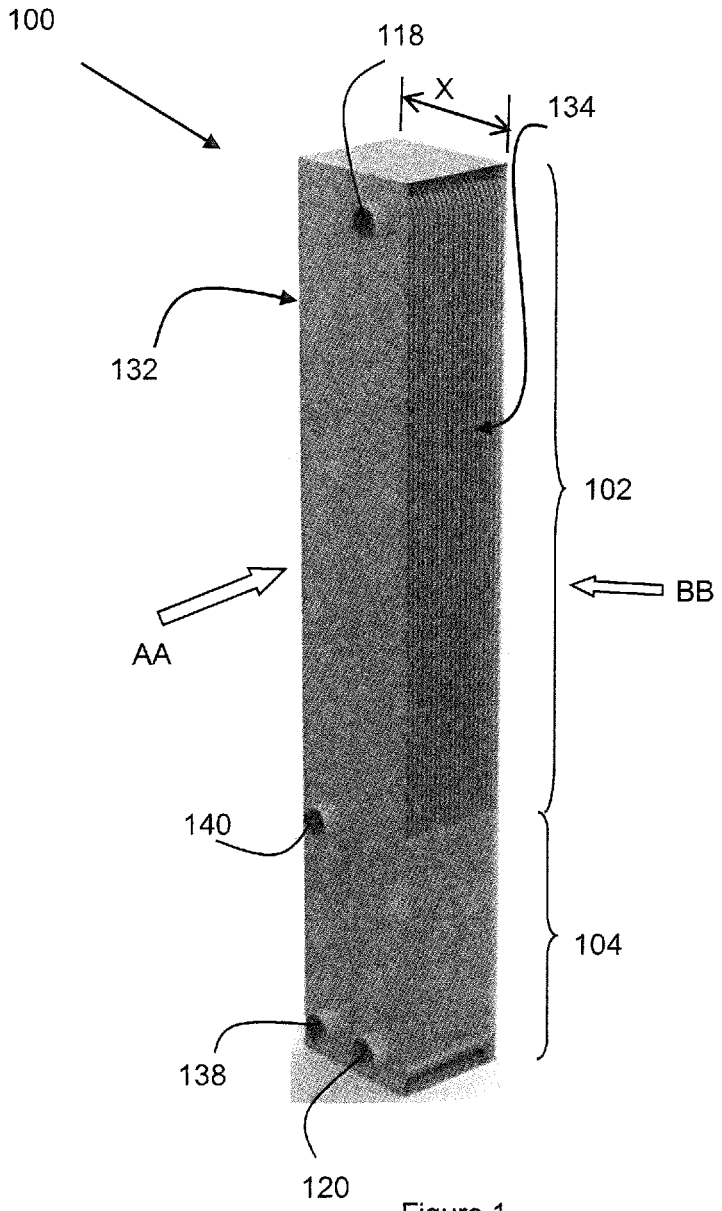
- FIG. 1 is a perspective view of a multi-fluid heat exchanger according to a first embodiment.

FIG. 1 a perspective view of a multi-fluid heat exchanger 100 according to a first embodiment. The multi-fluid heat exchanger 100 includes a primary section 102 and a secondary section 104 contiguous with the primary section 102. In the first embodiment, the primary section 102 is arranged on top of the secondary section 104 to create a compact and integrated vertical unit.

Figure 2:
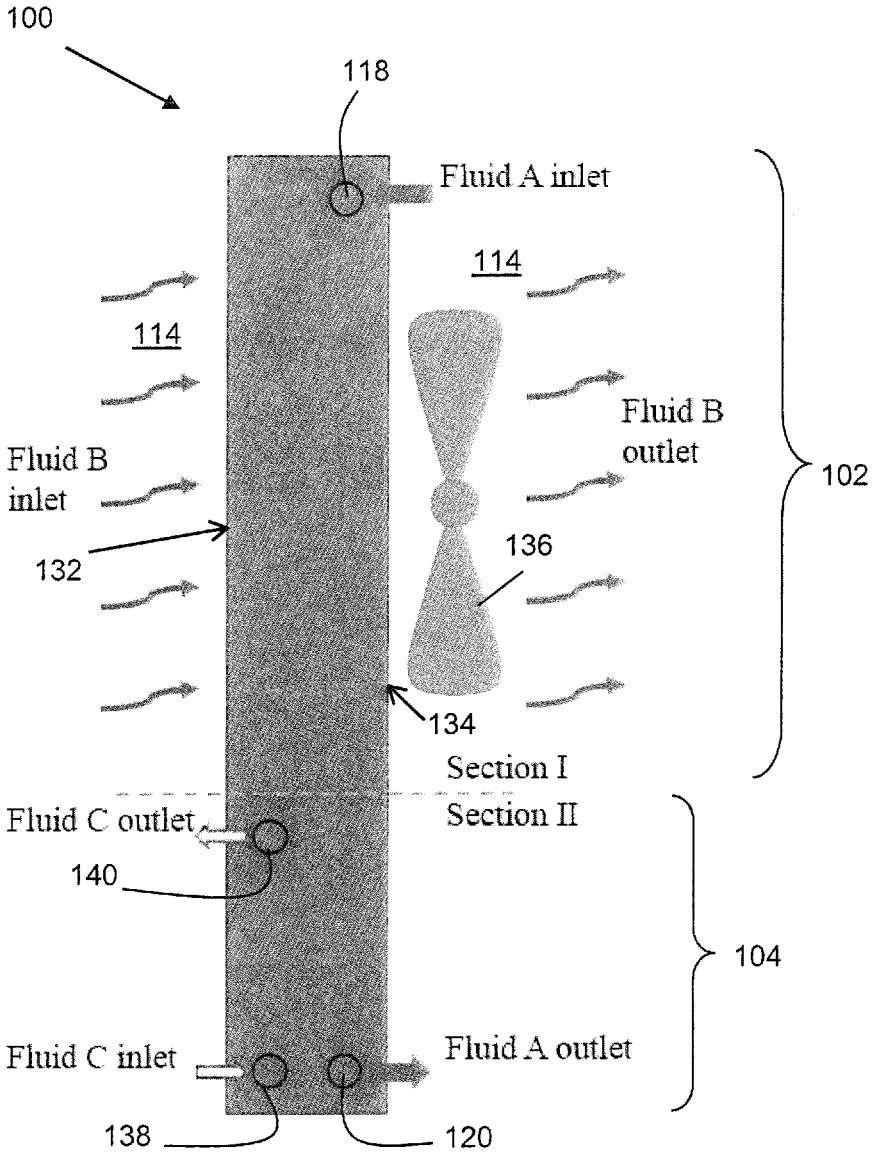
- FIG. 2 is a front view of the multi-fluid heat exchanger of FIG. 1 from a direction AA to illustrate ingress and egress locations of three fluids.
Figures 3, 4:
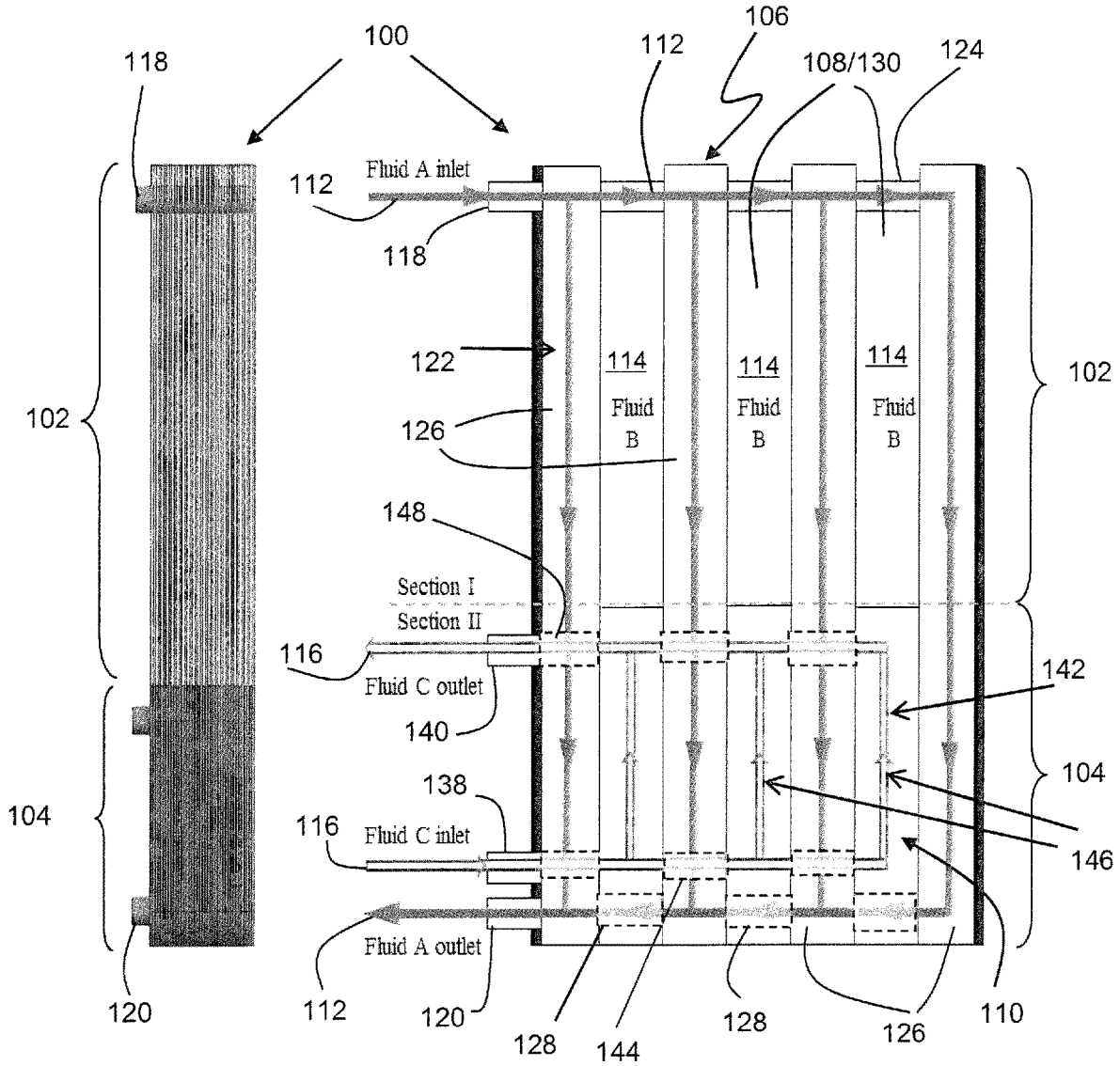
- FIG. 3 is an exploded side view of the heart exchanger of FIG. 1 in a direction BB.
- FIG. 4 is a simplified and enlarged schematic diagram illustrating fluid flow paths of the multi-fluid heat exchanger of FIG. 1 with reference to the view of FIG. 3.

FIG. 2 is a front view of the multi-fluid heat exchanger 100 of FIG. 1 from a direction AA and FIG. 3 is side view of the heart exchanger 100 of FIG. 1 in a direction BB. Further, FIG. 4 is a simplified and enlarged schematic diagram illustrating fluid flow paths of the multi-fluid heat exchanger 100 of FIG. 1.

In this embodiment, the multi-fluid heat exchanger 100 uses three fluid mediums for heat exchange, and accordingly, the heat exchanger 100 includes three fluid channels 106,108,110 for carrying respective first, second and third fluids 112, 114, 116 as the fluid mediums (denoted also respectfully as Fluid A, B and C in the figures).

In this embodiment, the first fluid channel 106 includes a first fluid inlet 118, a first fluid outlet 120 and a first fluid heat exchange chamber 122 connected therebetween. The first fluid heat exchanger chamber 122 includes an elongate first fluid inlet linking channel 124 connected to the first fluid inlet 118. The first fluid inlet linking channel 124 extends into a series of elongate first fluid chambers 126 having respective axis substantially orthogonal to the first fluid inlet linking channel 124. The series of elongate first fluid chambers 126 run along the longitudinal axis of the first and secondary sections 102,104 and are spaced from each other to define the second fluid channel 108 therebetween. In this way, the first fluid channel extends between the primary and secondary sections 102,104. In this embodiment, there is an even number of first fluid chambers 126 and specifically four fluid plate-type chambers.

The series of first fluid chambers 126 is further connected to a first fluid outlet linking channel 128 arranged in orthogonal relationship to the first fluid chambers 126 similar to the first fluid inlet linking channel 124, and the first fluid outlet linking channel 128 is coupled to the first fluid outlet 120. In this way, the first fluid 112 is carried through the first fluid inlet 118 into the series of first fluid chambers 126 via the first fluid inlet linking channel 124, and into the first fluid outlet linking channel 128 and exits via the first fluid outlet 120.

It should be noted that the first fluid inlet 118 is disposed at the primary section 102 near an upper edge of the heat exchanger 100, and the first fluid outlet 120 is disposed at the secondary section 104 near a lower edge of the heat exchanger 100 so that the first fluid channel 106, and specifically the series of first fluid chambers 126 extend between the first and secondary sections 102,104, in order to deliver the first fluid 112 through both the first and secondary sections 102,104.

The second fluid channel 108 includes a plurality of second channel passageways 130 interleaved between the series of first fluid chambers 126 and the second channel passageways 130 are arranged to carry the second fluid 114 through a shortest direct path (denoted by X in FIG. 1) of the heat exchanger 100. It should be appreciated that the second fluid channel's second fluid inlet 132 and outlet 134 extends an entire length of the primary section 102 and this achieves a more efficient passage of the second fluid 114 through the heat exchanger 100. In this embodiment, the second fluid 114 is air and the heat exchanger includes a blower 136 for drawing the air through the second channel passageway 130 (see FIG. 2).

It should also be appreciated that the second fluid channel 108 is disposed only in the primary section 102 in order to carry out heat exchange between the second fluid 114 and the first fluid 112.

The third fluid channel 110 comprises a third fluid inlet 138, a third fluid outlet 140 and a third fluid heat exchange chamber 142 connected therebetween. The third fluid heat exchanger chamber 142 includes an elongate third fluid inlet linking channel 144 which runs substantially parallel to the first fluid inlet linking channel 124 and is connected to the third fluid inlet 138. The third fluid inlet linking channel 144 extends into a series of elongate third fluid chambers 146 having respective axis substantially orthogonal to the third fluid inlet linking channel 144. The series of elongate third fluid chambers 146 run along the longitudinal axis of (only) the secondary section 104 and are spaced from each other, alternately with the first fluid chambers 126. In this embodiment, there are three third fluid plate-type chambers 146 interleaved with the four first fluid chambers 126 in the secondary section 104.

At the other end, the series of third fluid chambers 146 is further connected to a third fluid outlet linking channel 148 arranged in orthogonal relationship with the third fluid chambers 146 similar to the third fluid inlet linking channel 148, and the third fluid outlet linking channel 148 is coupled to the third fluid outlet 140. In this way, the third fluid 116 is carried through the third fluid inlet 138 into the series of third fluid chambers 146 via the third fluid inlet linking channel 144, and into the third fluid outlet linking channel 148 and exits via the third fluid outlet 140.

It should be noted that the third fluid inlet 116 is disposed near the lower edge of the heat exchanger 100 (near the first fluid outlet 120), and the third fluid outlet 140 is arranged near the boundary with the primary section 102. As a result, the third fluid channel 116, and specifically the series of third fluid chambers 146 are arranged only in the secondary section 104, in order to deliver the third fluid 116 through the secondary section 104 only. This also means that the third fluid 116 does not share any physical space with the second fluid 114 and the third and second fluid channels 110,108 are physically apart.

With this arrangement, the primary section 102 of the heat exchanger 100 can be regarded as an extension of the secondary section 104, and the first fluid 106 is arranged to enter the primary section 102 where the first fluid 106 flows through the series of first fluid chambers 126 in the primary section 102 and the first fluid 112 transfers heat with the second fluid 114 which flows through the second channel passageways 130 (i.e. gaps defined between the series of first fluid chambers 126) as drawn by the blower 136.

When the first fluid 112 enters the secondary section 104, which may be broadly configured as a plate heat exchanger section, the first fluid channel 106 alternates with the third fluid channel 110 (with reference to the longitudinal axis of the heat exchanger and as seen from FIG. 4). In other words, the first and third fluids 112,116 flow in the two groups of first and third fluid chambers 126,146 respectively, and transfer heat through the chambers (which may be configured as plates) between them.

Broadly, this means that the blower 136 draws the second fluid 114 through the second fluid channel 108 and as the second fluid 114 flows through the second channel passageways 130, the second fluid 114 transfers heat with the first fluid 112. For the secondary section 104, the third fluid 116 flows through the "shorter" third fluid channel 110 in the secondary section 104 where the third fluid 116 transfers heat with the first fluid 112.

In a specific example, the multi-fluid heat exchanger 100 may replace rear door heat exchanger of a data centre racks. The first fluid 112 may be a supply coolant and arranged to flow in the first fluid channel 106 through the "longer" first fluid channel chamber 126 and the third fluid 116 may be a server coolant which flows in the "shorter" third fluid channel 146. The second fluid 114 may then be rack air drawn through the second channel passageway 130. Consequently, the supply coolant is arranged to transfer heat with the rack air and also with the server coolant. By this, the rack air in the second fluid channel 108 may be cooled down by the supply coolant in the first fluid channel 106 before it is drawn into servers of the data center to cool down other heat sources in the servers, and may be recirculated back the multi-fluid heat exchanger 100 to be cooled again. The supply coolant further cools down the server coolant in the secondary section 104 before the server coolant is pumped into servers to cool down the CPU, GPU and other main heat sources, and similarly, the server coolant may be recirculated back to the multi-fluid heat exchanger 100 to be cooled again. Since liquid (the first fluid 112) is used to absorb part of the heat generated than all of it, and leave the rest of the heat handled by air cooling, the multi-fluid heat exchanger 100 is more energy and cost efficient.

In another specific example, the multi-fluid heat exchanger 100 may be used to recover waste heat of condenser coils in air conditioning units. To elaborate, the multi-fluid heat exchanger may replace normal condenser coils with refrigerant as the first fluid 112 flowing in the first fluid channel 106, ambient air as the second fluid 114 flowing in the second channel passageways 130 between the first fluid channel chambers 126, and liquid/two-phase flow that is harvesting waste heat flowing in the secondary section 104. With this arrangement, the multi-fluid heat exchanger 100 is arranged to dissipate heat and harvest waste heat at the same time, has a compact and unitary profile.

Further, in relation to certain known heat exchangers, the symmetrical and periodic first fluid channel chamber structure of the described embodiment assists with uniformity of heat transfer. At the first and second fluid boundaries, the longer chamber/plate design for the first fluid channel 106 together with the shortest pathway defined by the second fluid channel 108 for the second fluid 114 and high opening ratio achieves a lower pressure drop in the second fluid channel 106. Further, the simple inner structure of the multi-fluid heat exchanger 100 reduces possibility of fouling.

In general, the high heat transfer efficiency and low pressure drop of the primary and secondary sections 102,104 may help to improve the thermal and hydraulic performance of the heat exchanger 100. In the end, highly efficient heat transfers between the first fluid 112 and the second fluid 114 as well as between the first fluid 112 and the third fluid 116 are achievable. It should be appreciated that the first fluid 112 performs the heat exchange with the second fluid 114 at a different stage when compared with the heat exchange between the first fluid 112 and the third fluid 116. Specifically, with reference to the fluid flow of the first fluid 112, since the secondary section 104 is arranged downstream of the primary section 102 in this embodiment, the heat exchange between the first fluid 112 and the second fluid 114 is performed upstream of the heat exchange between the first fluid 112 and the third fluid 116.

The described embodiment should not be construed as limitative. For example, the first, second and third fluids 112,114,116 may be liquid or gas/air, and there may be more than three fluid mediums. Using FIG. 4 as an example, the primary section 102 may be duplicated below the secondary section 104 with the "second" primary section being used to transfer heat between the first fluid 112 and a further fluid. The first, second and third channels 106,108,110 may take the form of other structures, and may not be the structure or topology illustrated in FIG. 4. For example, there may be more than four elongate first fluid chambers 126 for the first fluid channel 106, and similarly, this would also change the topology of the second fluid channel 108 too. Likewise, the third fluid channel 110 may have different numbers of elongate third fluid chambers 146, depending on application.

Further, it would be apparent that the fluid flow directions of the first, second and third fluids 112, 114, 116 may be reversed or changed accordingly and may not be what are illustrated in the figures.

In a further example, the primary section 102 and the secondary section 104 may be placed side-by-side instead of one on top of the other and this possibility is illustrated in FIGS. 5 to 8 as a second embodiment.

Figure 5:
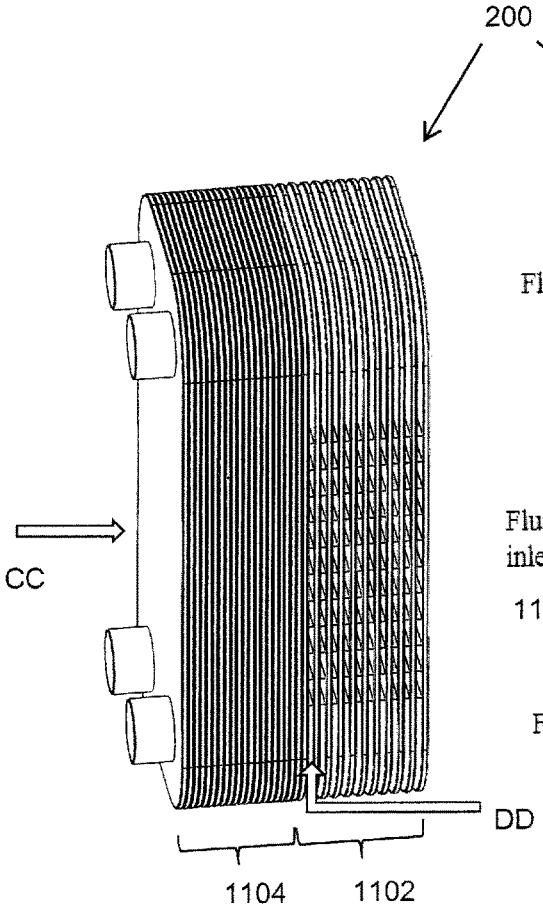
- FIG. 5 illustrates a multi-fluid heat exchanger according to a second embodiment.
Figure 6:
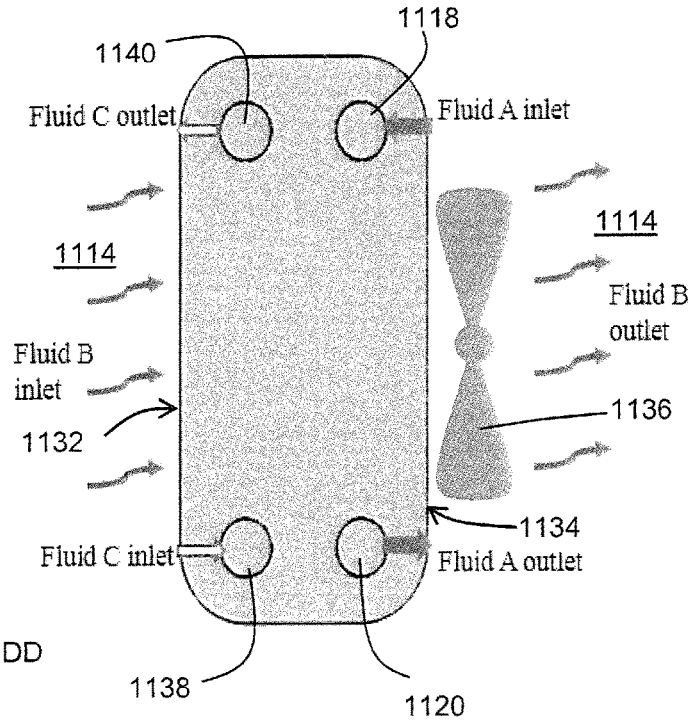
- FIG. 6 is a front view of the multi-fluid heat exchanger of FIG. 5 from a direction CC to illustrate ingress and egress locations of three fluids.

FIG. 5 is a perspective view of a second embodiment multi-fluid heat exchanger 200 and since the second embodiment is similar to the first embodiment, similar references would be used for like parts with the addition of 1000. As it can be appreciated, the first and secondary sections 1102, 1140 of the second embodiment multi-fluid heat exchanger is placed side by side and in congruity with each other and integrally formed as one unit. FIG. 6 illustrates a schematic front view of the second embodiment multi-fluid heat exchanger 200 in the direction CC of FIG. 5.

In the second embodiment, the first fluid inlet 1118 and the first fluid outlet 1120 are disposed on an exterior wall of the secondary section 1104, and likewise, the third fluid inlet 1138 and the third fluid outlet 1140 are similarly disposed at the secondary section 1104. Since the primary section 1102 is arranged side-by-side with the secondary section 1104, both sections have substantially the same height and accordingly, the second fluid inlet 1132 and outlet 1134 extends across the entire height of both sections 1102, 1104 although as described below, the second fluid 1114 is only arranged for heat transfer with the first fluid 1112 in the primary section 1102.

Figure 7:
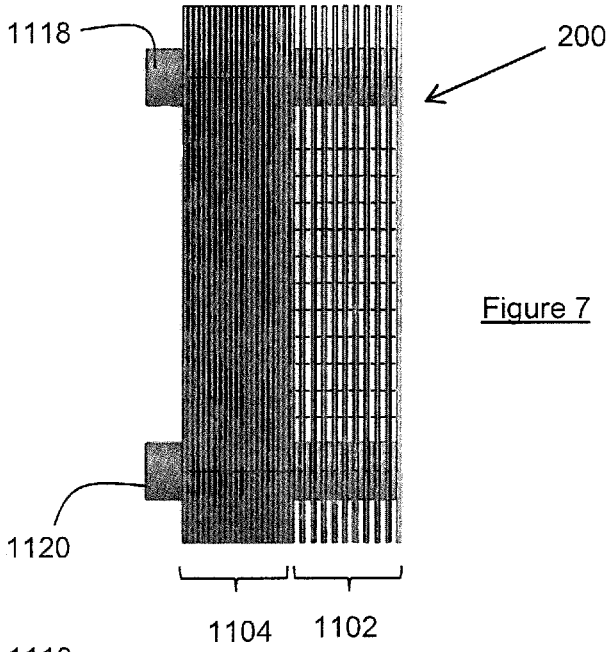
- FIG. 7 is an exploded side view of the heat exchanger of FIG. 5 in a direction DD.
Figure 8:
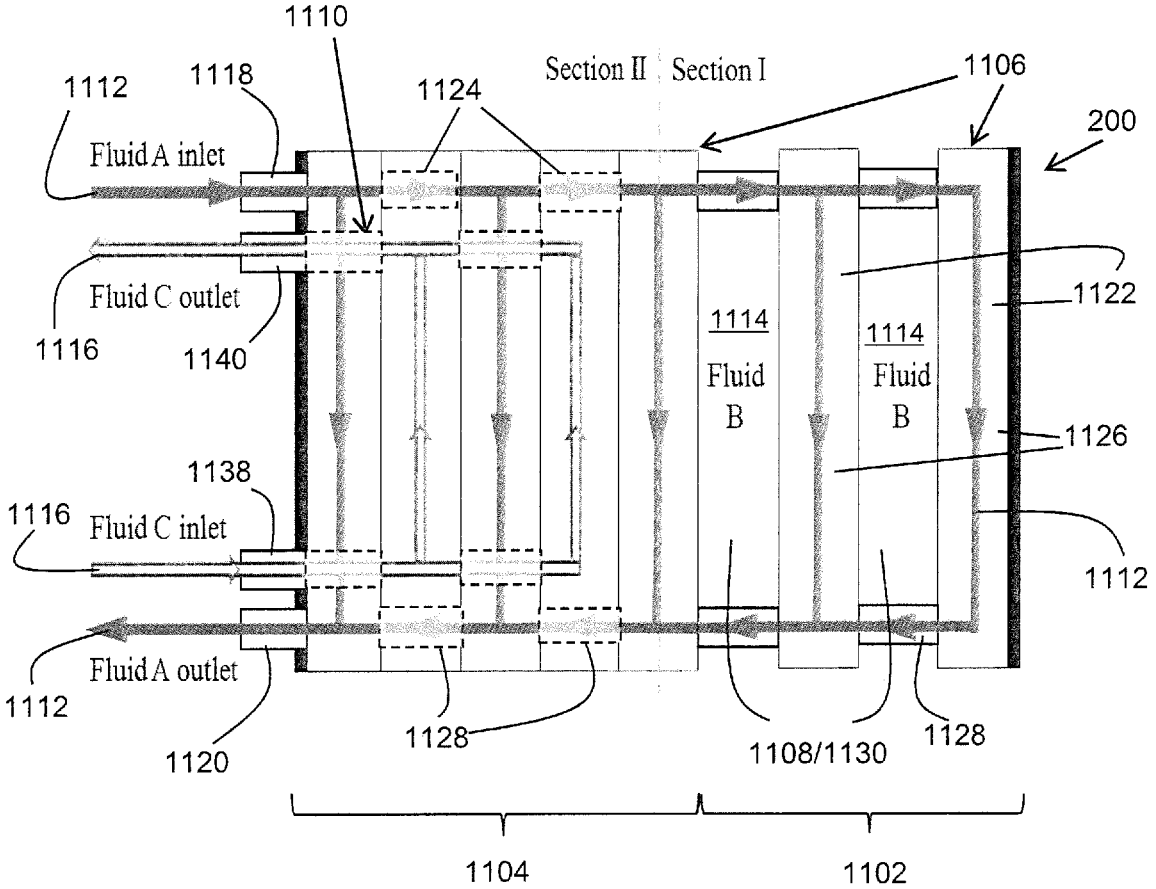
- FIG. 8 is a simplified and enlarged schematic diagram illustrating fluid flow paths of the multi-fluid heat exchanger of FIG. 4 with reference to the view of FIG. 7.

FIG. 7 is an exploded side view of the second embodiment multi-fluid heat exchanger 200 of FIG. 5 in a direction DD, and FIG. 8 is a simplified and enlarged schematic diagram illustrating fluid flow paths of the second embodiment heat exchanger 220. It should be mentioned that the third fluid inlet 1138 and outlet 1140 are illustrated as offset relative to the first and second fluid inlet 1118 and outlet 1120 so that the flow paths of the first and third fluids 1112,1116 could be illustrated, although in this embodiment, the inlets and outlets are aligned as shown in FIG. 6.

With reference to the flow path of the first fluid 1112, the primary section 1102 is arranged downstream of the secondary section 1104 but similar to the first embodiment, the first fluid channel 1106 extends between the primary and secondary sections 1102,1104. Specifically, in the second embodiment, the elongate first fluid inlet linking channel 1124 of the first fluid heat exchanger chamber 1122 extends between the primary and secondary sections 1102,1104 in order to carry the first fluid 1112 between the two sections 1102,1104. The elongate first fluid inlet linking channel 1124 similarly branches into a number of elongate first fluid chambers 1126 but in this embodiment, some of the elongate first fluid chambers 1126 are disposed in the primary section 1102 whereas some are disposed in the secondary section 1104. The series of first fluid chambers 1126 are further connected to the first fluid outlet linking channel 1128 which directs the first fluid to the first fluid outlet 1120. Accordingly, those elongate first fluid chambers 1126 disposed in the primary section 1102 are spaced apart to define the second fluid channel 1108 and the passageways 1130 for the second fluid 1114 to transfer heat with the first fluid 1112. Just like the first embodiment, the second fluid 1114 is gas or air, and a blower 1136 is used to draw the second fluid 1114 through the shortest path of the heat exchanger 200 and for heat exchange with the first fluid 1112.

In the case of those first fluid chambers 1126 disposed in the secondary section 1104, the first fluid 1112 carried by these first fluid chambers 1126 would then be arranged for heat transfer with the third fluid 1116 since the third fluid channel 1110 is arranged at the secondary section 1104.

With the above arrangement, just like the first embodiment, the multi-fluid heat exchanger 200 of the second embodiment also has the first channel extending between the primary and secondary sections 1102,1104 and thus, the heat exchange between the first fluid 1112 and the second fluid 1114; and between the first fluid 1112 and the third fluid 1116 are demarcated. The high heat transfer efficiency and low pressure drop of the primary and secondary sections 1102, 1104 may help to improve the thermal and hydraulic performance of the heat exchanger 200. In the end, highly efficient heat transfers between the first fluid 1112 and the second fluid 1114 as well as between the first fluid 1112 and the third fluid 1116 are achievable.

Figure 9:
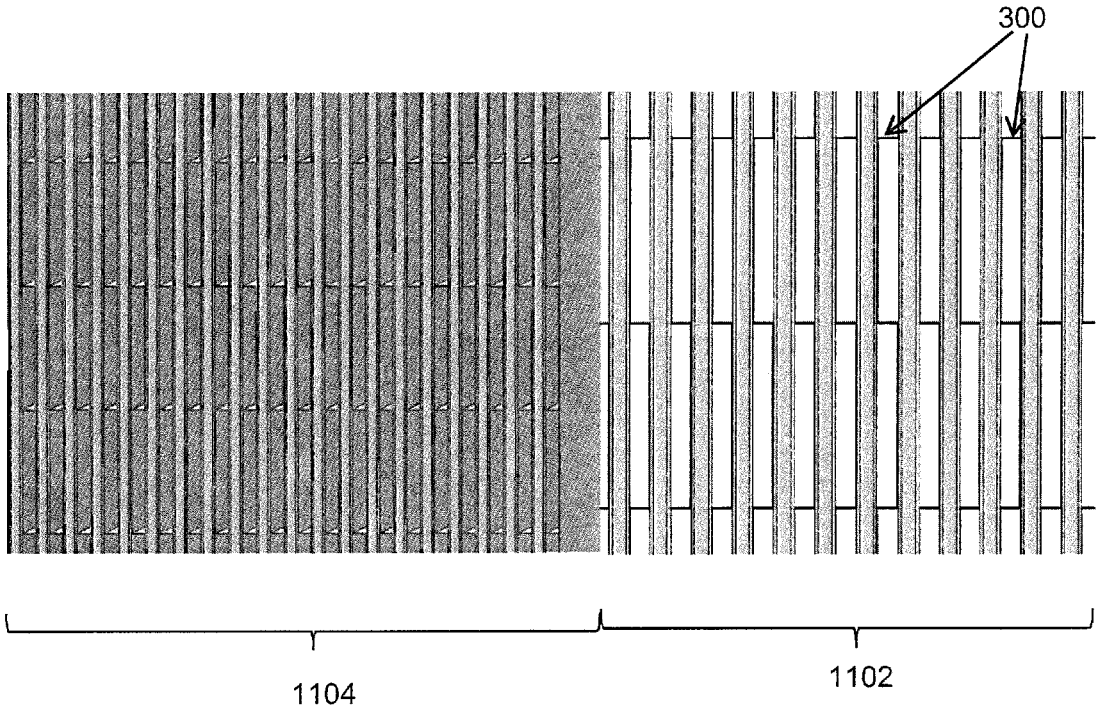
- FIG. 9 is a simplified and enlarged schematic diagram using the second embodiment of FIG. 5 as an example showing one section with fins.

To balance the heat transfer efficiency difference between the first fluid 112,1112, which may be liquid or two-phase fluid, and the second fluid 114,1114, which may be gas (or air), fins may be used in the primary section 102,1102. Using the second embodiment as an example, the primary section 1102 is illustrated in FIG. 9 to include fins 300 for heat transfer.

Having now fully described the invention, it should be apparent to one of ordinary skill in the art that many modifications can be made hereto without departing from the scope as claimed.

The invention claimed is:

1. A multi-fluid heat exchanger comprising a primary section and a secondary section arranged contiguous with the primary section;

a first heat transfer channel arranged to carry a first fluid along a first flow path, the first heat transfer channel extending between the primary section and the secondary section and arranged to carry the first fluid between the sections;

a second heat transfer channel disposed only at the primary section and arranged to carry a second fluid for heat exchange between the first and second fluids at the primary section; and a third heat transfer channel disposed only at the secondary section and arranged to carry a third fluid for heat exchange between the first and third fluids at the secondary section; wherein the third fluid is a liquid and the second fluid is a gas, and the heat exchanger includes a blower for drawing the second fluid through the second heat transfer channel along a second flow path which crosses the first flow path of the first fluid.

2. The multi-fluid heat exchanger according to claim 1, wherein the first heat transfer channel includes a plurality of first fluid chambers, at least some of which are interleaved by respective ones of a plurality of second fluid passages of the second heat transfer channel.

3. The multi-fluid heat exchanger according to claim 2, wherein all of the plurality of first fluid chambers extend between the primary section and the secondary section.

4. The multi-fluid heat exchanger according to claim 3, wherein the first heat transfer channel includes a first fluid inlet disposed at the primary section and a first fluid outlet disposed at the secondary section.

5. The multi-fluid heat exchanger according to claim 3, wherein the third heat transfer channel includes a third fluid inlet disposed at the secondary section and a third fluid outlet disposed at the secondary section.

6. The multi-fluid heat exchanger according to claim 3, wherein the secondary section is arranged downstream of the primary section in relation to a flow path of the first fluid.

7. The multi-fluid heat exchanger according to claim 2, wherein some of the plurality of first fluid chambers are disposed in the primary section and some of the plurality of first fluid chambers are disposed in the secondary section.

8. The multi-fluid heat exchanger according to claim 7, wherein the first heat transfer channel includes a first fluid inlet and outlet disposed at the secondary section.

9. The multi-fluid heat exchanger according to claim 7, wherein the third heat transfer channel includes a third fluid inlet and outlet disposed at the secondary section.

10. The multi-fluid heat exchanger according to claim 7, wherein the primary section is arranged downstream of the secondary section in relation to a flow path of the first fluid.

11. The multi-fluid heat exchanger according to claim 2, wherein there is an even number of first fluid chambers.

12. The multi-fluid heat exchanger according to claim 1, wherein the second heat transfer channel includes a second fluid inlet and outlet which extends an entire length of the primary section.

13. The multi-fluid heat exchanger according to claim 1, wherein the primary and secondary sections are integrally formed as a unitary structure.

* * * * *